US010474091B2

(12) United States Patent
Ishida et al.

(10) Patent No.: US 10,474,091 B2
(45) **Date of Patent: *Nov. 12, 2019**

(54) DRIVE DEVICE AND IMAGE FORMING APPARATUS INCORPORATING THE DRIVE DEVICE

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/134,296

(22) Filed: Sep. 18, 2018

(65) Prior Publication Data

US 2019/0018361 A1 Jan. 17, 2019

Related U.S. Application Data

(63) Continuation of application No. 15/215,747, filed on Jul. 21, 2016, now Pat. No. 10,120,328.

(30) Foreign Application Priority Data

Jul. 30, 2015 (JP) ..... 2015-151211
Jul. 14, 2016 (JP) ..... 2016-139600

(51) Int. Cl.
*G03G 21/16* (2006.01)
*G03G 15/00* (2006.01)

(52) U.S. Cl.
CPC ..... *G03G 21/1647* (2013.01); *G03G 15/6552* (2013.01); *G03G 15/6529* (2013.01);
(Continued)

(58) Field of Classification Search
CPC ..... F16H 1/02; F16H 3/14; G30G 15/757; G30G 21/1857; G30G 21/1647;
(Continued)

(56) References Cited

U.S. PATENT DOCUMENTS 10,120,328 B2 * 11/2018 Ishida ..... G03G 15/6552
2014/0251047 A1 9/2014 Matsuda et al.
(Continued)

FOREIGN PATENT DOCUMENTS

JP 06-236086 A 8/1994
JP 2014173676 A 9/2014

*Primary Examiner* — David H Banh
(74) *Attorney, Agent, or Firm* — Harness, Dickey & Pierce, P.L.C.

(57) ABSTRACT

A drive device, which is included in an image forming apparatus, includes a drive source, an input side rotary body, an output side rotary body, two drive transmission routes, a drive transmission state switcher, and a drive transmission changer. The input side rotary body receives a driving force from the drive source. The output side rotary body outputs the driving force to a driving target body. The drive transmission state switcher switches a first drive transmission route between a transmission state and a non transmission state. The drive transmission changer transmits the driving force via a second drive transmission route to the output side rotary body when the first drive transmission route is in the non transmission state and restricts the driving force from being transmitted via the second drive transmission route when the first drive transmission route to the output side rotary body is in the transmission state.

18 Claims, 5 Drawing Sheets

(52) U.S. Cl.
CPC ..... *G03G 2215/0132* (2013.01); *G03G 2221/1657* (2013.01)

(58) Field of Classification Search
CPC ..... G30G 15/6529; G30G 15/6552; G30G 2215/0132; G30G 2221/1657
See application file for complete search history.

(56) References Cited

U.S. PATENT DOCUMENTS

| | | | |
|---|---|---|---|
| 2014/0320877 | A1 | 10/2014 | Kaneko et al. |
| 2015/0082744 | A1 | 3/2015 | Tanaka et al. |
| 2015/0268614 | A1 | 9/2015 | Kiyama et al. |

* cited by examiner

DRIVE DEVICE AND IMAGE FORMING APPARATUS INCORPORATING THE DRIVE DEVICE

CROSS-REFERENCE TO RELATED APPLICATIONS

This is a continuation application of U.S. patent application Ser. No. 15/215,747, filed Jul. 21, 2016, which claims priority pursuant to 35 U.S.C. § 119(a) to Japanese Patent Application Nos. 2015-151211, filed on Jul. 30, 2015, and 2016-139600, filed on Jul. 14, 2016, in the Japan Patent Office, the entire disclosure of each of which is hereby incorporated by reference herein.

BACKGROUND

Technical Field

This disclosure relates to a drive device and an image forming apparatus incorporating the drive device.

Related Art

Various types of image forming apparatuses include copiers, printers, facsimile machines, or multifunction peripherals (MFPs) having two or more of copying, printing, scanning, facsimile transmission, plotter, and other capabilities. Such image forming apparatuses include various drive devices for image forming operations.

The drive device causes a sheet ejecting roller to rotate in a regular direction and a reverse direction. The drive device includes an input shaft and an output shaft and further includes a forward drive transmission route and a reverse drive transmission route. The forward drive transmission route and the reverse drive transmission route include respective clutches. When the clutch of the forward drive transmission route is turned on and the clutch of the reverse drive transmission route is turned off, the output shaft rotates in a forward direction by the driving force transmitted through the forward drive transmission route, and therefore the sheet ejecting roller rotates in the forward direction. By contrast, when the clutch of the forward drive transmission route is turned off and the clutch of the reverse drive transmission route is turned on, the output shaft rotates in a reverse direction by the driving force through the reverse drive transmission route, and therefore the sheet ejecting roller rotates in the reverse direction.

SUMMARY

At least one aspect of this disclosure provides a drive device including a drive source, an input side rotary body, an output side rotary body, two drive transmission routes, a drive transmission state switcher, and a drive transmission changer. The drive source exerts a driving force. The input side rotary body is rotatably disposed to receive the driving force from the drive source. The output side rotary body is rotatably disposed to output the driving force to a driving target body. The two drive transmission routes transmit the driving force from the input side rotary body to the output side rotary body and includes a first drive transmission route and a second drive transmission route. The drive transmission state switcher is configured to switch the first drive transmission route between a transmission state in which the driving force is transmitted and a non transmission state in which the transmission of the driving force is cut off. The drive transmission changer is configured to transmit the driving force via the second drive transmission route to the output side rotary body when the first drive transmission route is in the non transmission state and is configured to restrict the driving force from being transmitted via the second drive transmission route when the first drive transmission route to the output side rotary body is in the transmission state.

Further, at least one aspect of this disclosure provides an image forming apparatus including the above-described drive device to transmit a driving force to drive the driving target body.

DETAILED DESCRIPTION

Figure 1:
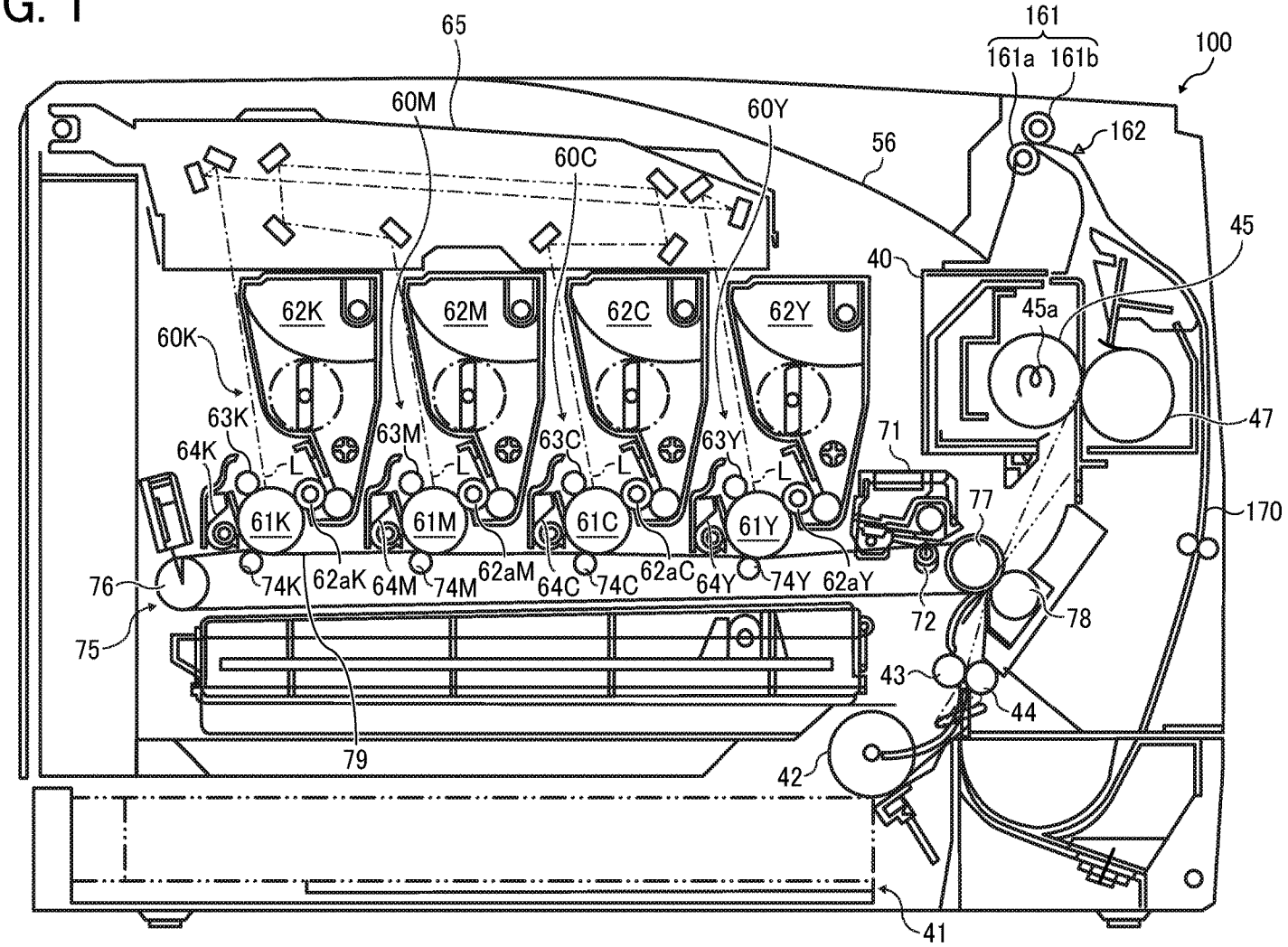
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 100 for forming images by electrophotography, according to an embodiment of this disclosure. It is to be noted that, hereinafter, the electrophotographic image forming apparatus 100 is referred to as the image forming apparatus 100.

Now, a description is given of a basic configuration of the image forming apparatus 100 according to the present embodiment of this disclosure.

FIG. 1 is a schematic diagram illustrating the image forming apparatus 100 according to the present embodiment of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 100 includes four process units 60Y, 60C, 60M, and 60K to form respective toner images of yellow (Y), cyan (C), magenta (M), and black (K). The configurations of the process units 60Y, 60C, 60M, and 60K are basically identical to each other, except that the process units 60Y, 60C, 60M, and 60K include toners of different colors. Each of the process units 60Y, 60C, 60M, and 60K is replaced at the end of its service life.

Since the process units 60Y, 60C, 60M, and 60K have respective configurations identical to each other except the toner colors, the process unit 60 and image forming components included in the process unit 60 are occasionally described without suffixes indicating the toner colors, which are Y, C, M, and K. The process unit 60 (i.e., process units 60Y, 60C, 60M, and 60K) includes a drum-shaped photoconductor 61 (i.e., photoconductors 61Y, 61C, 61M, and 61K), a developing device 62 (i.e., developing devices 62Y, 62C, 62M, and 62K), a charging device 63 (i.e., charging devices 63Y, 63C, 63M, and 63K), a drum cleaning device 64 (i.e., drum cleaning devices 64Y, 64C, 64M, and 64K), and a static eliminating device (i.e., static eliminating devices). The process unit 60 that functions as an image forming device is detachably attachable to an apparatus body of the image forming apparatus 100, and consumable parts of the process unit 60 can be replaced at one time.

The charging device 63 uniformly charges a surface of the photoconductor 61 that is rotated by a drive device in a clockwise direction in FIG. 1. An optical writing device 65 emits laser light L so as to irradiate the uniformly charged surface of the photoconductor 61 to form an electrostatic latent image of each single color toner. The developing device 62 in which toner is included develops the electrostatic latent image into a visible toner image. Then, the toner image is primarily transferred onto a surface of the intermediate transfer belt 79.

The drum cleaning device 64 removes residual toner remaining on the surface of the photoconductor 61 after a primary transfer operation.

Further, the static eliminating device removes residual electric potential remaining on the surface of the photoconductor 61 after the drum cleaning device 64 has cleaned the surface of the photoconductor 61. This removal of static electricity initializes the surface of the photoconductor 61, so as to prepare for a subsequent image formation.

As previously described, the above-described detailed operations are performed in each of the process units 60Y, 60C, 60M, and 60K. For example, respective toner images are developed on the respective surfaces of the photoconductors 61Y, 61C, 61M, and 61K and are then sequentially transferred onto the surface of the intermediate transfer belt 79 to form a composite color image. It is to be noted that a cylindrical drum part of the photoconductor 61 is manufactured by a hollow aluminum tube with a front face thereof covered by an organic photoconductive layer. Flanges having a drum shaft are attached to both axial ends of the cylindrical drum part to form the photoconductor 61. As a developing roller 62*a* of the developing device 62 rotates, the electrostatic latent image moves to a developing region where the developing roller 62*a* is disposed facing the photoconductor 61. The developing device 62 supplies toner contained therein to the toner image formed on the surface of the photoconductor 61 in the developing region to develop the electrostatic latent image into a visible toner image.

As previously described with FIG. 1, the above-described detailed operations are performed in each of the process units 60Y, 60C, 60M, and 60K. For example, respective toner images are developed on the respective surfaces of the photoconductors 61Y, 61C, 61M, and 61K and are then sequentially transferred onto the surface of the intermediate transfer belt 79 to form a composite color image.

Figure 2:
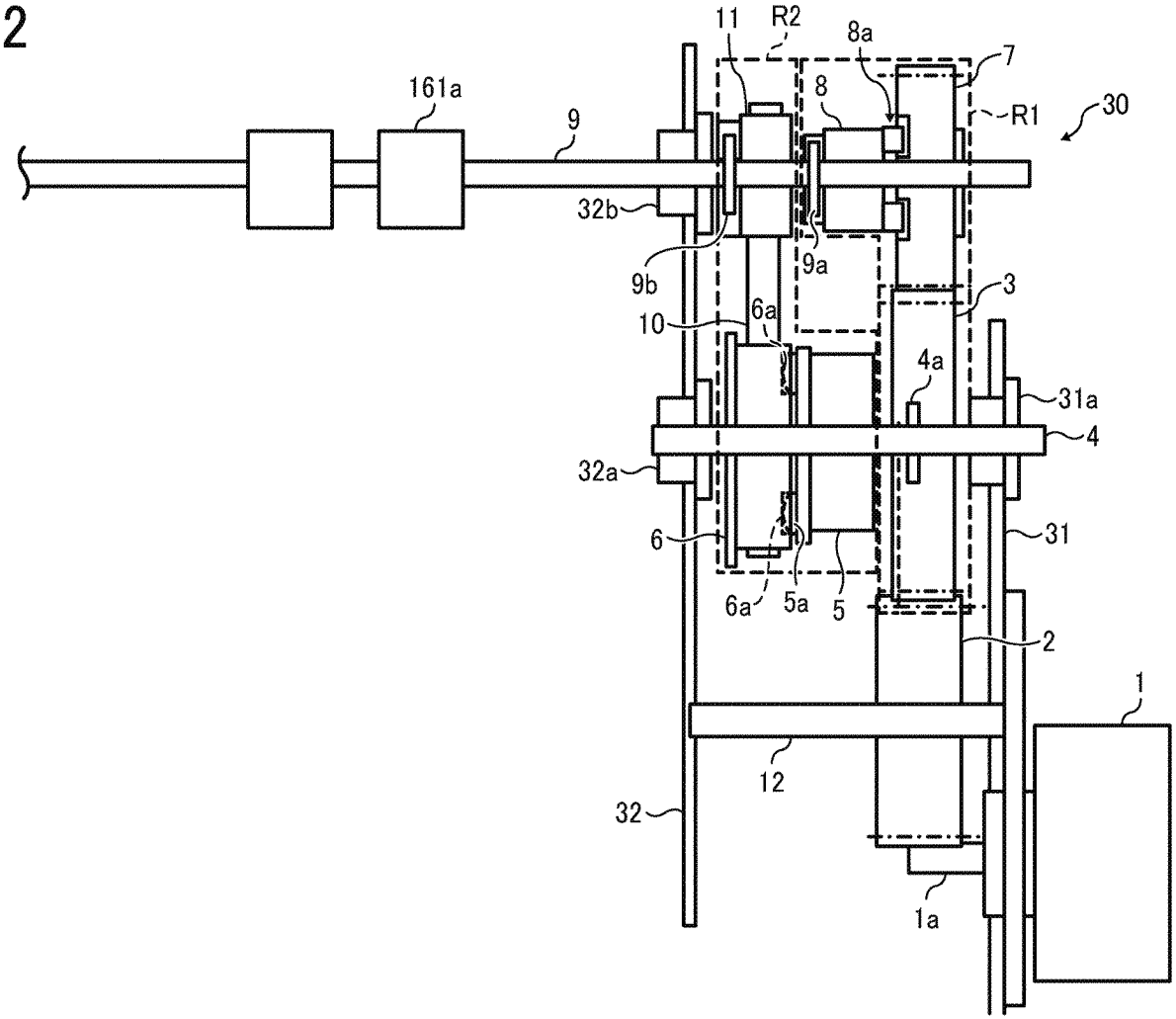
FIG. 2 is a schematic cross sectional view illustrating a drive device of Configuration Example 1.

As illustrated in FIG. 2, an optical writing device 65 is disposed vertically above the process units 60Y, 60C, 60M, and 60K. The optical writing device 65 functions as a latent image writing device. The optical writing device 65 emits laser light L from a laser diode based on image data to optically scan the photoconductors 61Y, 61C, 61M, and 61K in the process units 60Y, 60C, 60M, and 60K, respectively. Due to this optical scanning, an electrostatic latent image is formed on the surface of each photoconductor 61. In this configuration, the optical writing device 65 and the four process units 60Y, 60C, 60M, and 60K form an image forming part that forms respective yellow, cyan, magenta, and black toner images, which are visible images of different colors from each other on three or more of the photoconductors 61Y, 61C, 61M, and 61K.

It is to be noted that, while causing a polygon motor to rotate a polygon mirror so as to deflect the laser light L emitted by a light source in a main scanning direction, the optical writing device 65 irradiates the deflected laser light L to the photoconductor 61 via multiple optical lenses and mirrors. The optical writing device 65 may be a device that performs optical writing by LED light emitted by multiple light emitting diodes (LEDs) of an LED array.

A transfer device 75 is disposed vertically below the process units 60Y, 60C, 60M, and 60K. The transfer device 75 functions as a belt device that rotates the intermediate transfer belt 79 endlessly in a counterclockwise direction in FIG. 1 while stretching the intermediate transfer belt 79 of an endless type with tension. The transfer device 75 includes the intermediate transfer belt 79, a drive roller 76, a tension roller 77, four primary transfer rollers 74Y, 74C, 74M, and 74K, a secondary transfer roller 78, a belt cleaning device 71, and a cleaning backup roller 72.

The intermediate transfer belt 79 functions as a belt member as well as a transfer belt. The intermediate transfer belt 79 is stretched by the drive roller 76, the tension roller 77, the cleaning backup roller 72, and the four primary transfer rollers 74Y, 74C, 74M, and 74K, which are disposed inside the loop of the intermediate transfer belt 79. Then, due to a rotation force of the drive roller 76 that is rotated by a drive device in the counterclockwise direction in FIG. 1, the intermediate transfer belt 79 is endlessly rotated in the same direction as movement of the drive roller 76.

The four primary transfer rollers 74Y, 74C, 74M, and 74K hold the endlessly rotating intermediate transfer belt 79 with the photoconductors 61Y, 61C, 61M, and 61K. In other words, the intermediate transfer belt 79 is held between the four primary transfer rollers 74Y, 74C, 74M, and 74K and the photoconductors 61Y, 61C, 61M, and 61K. By so doing, four primary transfer nip regions are formed on respective four positions where a front face of the intermediate transfer belt 79 contacts the respective photoconductors 61Y, 61C, 61M, and 61K.

Primary transfer biases are applied by a transfer power supply to the primary transfer rollers 74Y, 74C, 74M, and 74K, respectively. Accordingly, a transfer electric field is formed in each transfer nip region formed between the electrostatic latent image of the photoconductor 61 (i.e., the photoconductors 61Y, 61C, 61M, and 61K) and the primary transfer roller 74 (i.e., the primary transfer rollers 74Y, 74C, 74M, and 74K).

It is to be noted that the primary transfer roller 74 may be replaced with a transfer charger or a transfer brush.

The yellow toner image formed on the surface of the photoconductor 61Y of the process unit 60Y enters the primary transfer nip region as the photoconductor 61Y rotates. In the primary transfer nip region for yellow toner image, due to the transfer electric field and a nip pressure, the yellow toner image is primarily transferred from the photoconductor 61Y onto the intermediate transfer belt 79. After the yellow toner image is primarily transferred onto the intermediate transfer belt 79, the intermediate transfer belt 79 continues to rotate endlessly. As the intermediate transfer belt 79 rotates and passes the primary transfer nip regions for magenta, cyan, and black toner images, the magenta, cyan, and black toner images formed on the photoconductors 61M, 61C, and 61K are also primarily transferred and sequentially overlaid onto the yellow toner image previously formed the intermediate transfer belt 79. By primarily transferring the single color toner images, a four-color toner image is formed on the intermediate transfer belt 79.

The secondary transfer roller 21 included in the transfer device 75 is disposed outside the loop of the intermediate transfer belt 79 to hold the intermediate transfer belt 79 with the tension roller 77 disposed inside the loop of the intermediate transfer belt 79. By so doing, a secondary transfer nip region is formed between the front face of the intermediate transfer belt 79 and the secondary transfer roller 78. A secondary transfer bias is applied by the transfer bias power supply to the secondary transfer roller 78. This application of the secondary transfer bias forms a secondary transfer electric field between the secondary transfer roller 78 and the tension roller 77 that is electrically grounded.

A sheet tray 41 is disposed vertically below the transfer device 75. The sheet tray 41 accommodates multiple recording media Pin a bundle of sheets. The sheet tray 41 is slidably and detachably attached to the apparatus body of the image forming apparatus 100. The sheet tray 41 includes a feed roller 42 that is disposed in contact with an uppermost recording medium P that is placed on top of the bundle of sheets. As the feed roller 42 rotates in the counterclockwise direction in FIG. 1 at a predetermined timing, the recording medium P is fed toward a sheet conveying passage.

A pair of registration rollers is disposed at a far end of the sheet conveying passage. The pair of registration rollers includes two registration rollers 43 and 44, and therefore is occasionally referred to as the pair of registration rollers 43 and 44. The pair of registration rollers stops rotating on receiving the recording medium P fed from the sheet tray 41 between the two registration rollers 43 and 44. In synchronization of arrival of the four-color toner image formed on the intermediate transfer belt 79 in the secondary transfer nip region, the pair of registration rollers 43 and 44 starts rotating again to further convey the recording medium P toward the secondary transfer nip region.

When the four-color toner image formed on the intermediate transfer belt 79 closely contacts the recording medium P at the secondary transfer nip region, the four-color toner image is transferred onto the recording medium P due to the secondary transfer electric field and the nip pressure. At this time, the four-color toner image is combined with white color of the recording medium P to make a full-color toner image.

It is to be noted that, after passing through the secondary transfer nip region, residual toner that has not been transferred onto the recording medium P remains on the front face of the intermediate transfer belt 79.

The residual toner remaining on the front face of the intermediate transfer belt 79 is removed by the belt cleaning device 71 that is disposed in contact with the front face of the intermediate transfer belt 79. The cleaning backup roller 72 that is disposed inside the loop of the intermediate transfer belt 79 supports a belt cleaning operation performed by the belt cleaning device 71 from inside the loop of the intermediate transfer belt 79.

As the recording medium P with the full-color toner image on the front face thereof passes the secondary transfer nip region, the recording medium P separates from the secondary transfer roller 78 and the intermediate transfer belt 79 due to curvature separation. Then, the recording medium P travels through a post-transfer conveying passage and reaches a fixing device 40.

The fixing device 40 includes a fixing roller 45 and a pressure roller 47. The fixing roller 45 includes a heat generating source 45*a* such as a halogen lamp. The pressure roller 47 rotates while pressing against the fixing roller 45 with a predetermined pressing force. The fixing roller 45 and the pressure roller 47 contact each other to form a fixing nip region. The recording medium P conveyed to the fixing device 40 is held in the fixing nip region such that a face on which an unfixed toner image is formed closely contacts the fixing roller 45. Then, toner in the unfixed toner image melts by application of heat and pressure, so that the full-color toner image is fixed to the recording medium P.

In a case in which a single side printing mode is selected based on an input operation to a control unit or a control signal issued and transmitted from a personal computer, the recording medium P discharged from the fixing device 40 is ejected by a pair of sheet output rollers 161 to an outside of the image forming apparatus 100. The pair of sheet output rollers 161 rotates in a forward direction. Then, the recording medium P is stored on a sheet stacking portion 56 that is constructed by an upper face of a top cover of the apparatus body of the image forming apparatus 100.

While ejecting the recording medium P from the fixing device 40 to the sheet stacking portion 56, the pair of sheet output rollers 161 reversely rotates to switch back the recording medium P toward a sheet reentry passage 170 in a duplex printing mode. Specifically, the pair of sheet output rollers 161 includes two sheet output rollers 161*a* and 161*b*. When a sheet ejection sensor 162 detects that the recording medium P is nipped or held between the sheet output rollers 161*a* and 161*b*, the sheet output rollers 161*a* and 161*b* are reversely rotated. By so doing, the recording medium P passes through the sheet reentry passage 170 to be conveyed to the secondary transfer nip region again in a state in which the sides of the recording medium P are reversed so that an image can be transferred onto a back or opposite side of the recording medium P. Then, the recording medium P has passed through the secondary transfer nip region with the toner image transferred on the back of the recording medium P, the toner image is fixed to the recording medium P in the fixing device 40. After this fixing operation, the recording medium P is conveyed to the sheet stacking portion 56 by the pair of sheet output rollers 161.

It is to be noted that the sheet output roller 161*a* of the pair of sheet output rollers 161 is rotated by a drive device that is described below in the present embodiment. However, the configuration is not limited thereto as long as the drive device drives to rotate at least one of the pair of sheet output rollers 161.

Now, regarding a comparative drive device, there are a forward drive transmission route and a reverse drive transmission route. Each of the forward drive transmission route and the reverse drive transmission route include a clutch to switch drive transmission routes by determining whether a sheet output roller rotates in a forward direction or in a reverse direction that is an opposite direction to the forward direction. When switching the rotation of the sheet output roller between the forward direction and the reverse direction, the clutch provided to the forward drive transmission route and the clutch provided to the reverse drive transmission route perform by turns. Accordingly, the two clutches take time for switching of driving of the sheet output roller between the forward direction and the reverse direction.

In order to address the inconvenience, a description is given of the following configuration examples of a drive device according to an embodiment of this disclosure.

CONFIGURATION EXAMPLE 1

FIG. 2 is a schematic cross sectional view illustrating a drive device 30 that is included in the image forming apparatus 100 to drive the pair of sheet output roller 161*a*.

As illustrated in FIG. 2, the drive device 30 includes a motor 1 that functions as a drive source that can rotate in both forward and reverse directions. The motor 1 is attached to a side panel 31. The motor 1 includes a motor gear 1*a* that meshes with an idler gear 2.

The idler gear 2 is rotatably supported by a gear shaft 12 that is secured to the side panel 31 and a side panel 32.

A bearing 31*a* is mounted on the side panel 31 and a bearing 32*a* is mounted on the side panel 32. By so doing, a rotary shaft 4 that functions as an input side rotary shaft is rotatably supported by the bearing 31*a* and the bearing 32*a*.

An external gear 3 that meshes with the idler gear 2 is secured to the rotary shaft 4 by a parallel pin 4*a*. Therefore, the external gear 3 and the rotary shaft 4 rotates in a single unit.

Further, an electromagnetic clutch 5 and a pulley 6 are coaxially mounted on the rotary shaft 4. The electromagnetic clutch 5 and the pulley 6 are disposed closer to the sheet output roller 161*a* than the external gear 3 in an axial direction of the rotary shaft 4. The electromagnetic clutch 5 is supported by the rotary shaft 4 to be fastened to or released from the rotary shaft 4. The pulley 6 is rotatably supported by the rotary shaft 4.

A rotary shaft 9 of the sheet output roller 161*a* is an output side rotary shaft disposed at a position shifted from the rotary shaft 4 in a radial direction of the sheet output roller

161*a*. The rotary shaft 9 is rotatably supported by a bearing 32*b* that is mounted on the side panel 32.

An external gear 7 that meshes with the external gear 3 is rotatably mounted on the rotary shaft 9. The external gear 7 is engaged with a torque limiter 8 via a coupling 8*a*. The torque limiter 8 that functions as a drive transmission changer is secured to the rotary shaft 9 by a parallel pin 9*a* and spins when a torque that is greater than a predetermined set torque value is applied to the torque limiter 8.

Further, a pulley 11 is disposed closer to the sheet output roller 161*a* than the torque limiter 8 in an axial direction of the rotary shaft 9. The pulley 11 is secured to the rotary shaft 9 by a parallel pin 9*b*.

A timing belt 10 is wound around the pulley 6 mounted over the rotary shaft 4 and the pulley 11 mounted on the rotary shaft 9.

The drive device 30 illustrated in FIG. 2 includes a first drive transmission route R1 and a second drive transmission route R2, which are two routes of drive transmission routes to transmit a driving force exerted by the motor 1 to the sheet output roller 161*a*. The first drive transmission route R1 is defined by the external gear 3, the external gear 7, and the torque limiter 8. The second drive transmission route R2 is defined by the electromagnetic clutch 5, the pulley 6, the timing belt 10, and the pulley 11. In drive transmission via the first drive transmission route R1 and the second drive transmission route R2, the sheet output roller 161*a* rotates in opposite directions in the first drive transmission route R1 and the second drive transmission route R2. That is, the direction of rotation of the sheet output roller 161*a* in the first drive transmission route R1 is opposite to the direction of rotation of the sheet output roller 161*a* in the second drive transmission route R2.

Figure 3:
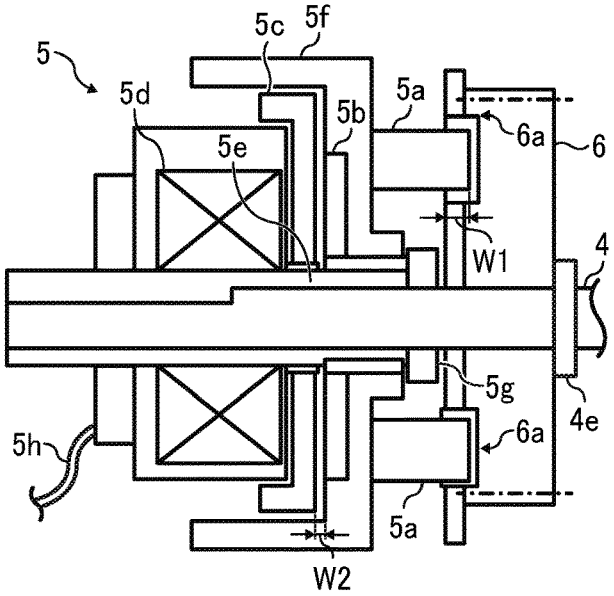
FIG. 3 is a diagram illustrating a schematic configuration of an electromagnetic clutch and a pulley.

FIG. 3 is a diagram illustrating a schematic configuration and relation of the electromagnetic clutch 5 and the pulley 6. The electromagnetic clutch 5 functions as a drive transmission state switcher that can switch a drive transmission by the driving force from the motor 1, between a transmission state in which the driving force is transmitted and a non transmission state in which the drive transmission of the driving force is cut off.

The electromagnetic clutch 5 includes a pair of driving pawls 5*a*, an armature 5*b*, a rotor 5*c*, an electromagnetic coil 5*d*, a shaft securing body 5*e*, a drive connector 5*f*, a clearance retainer 5*g*, and an electric wire 5*h*.

The electromagnetic coil 5*d* and the drive connector 5*f* are rotatably mounted on the rotary shaft 4.

The shaft securing body 5*e* has a tubular shape and is fixedly mounted on the rotary shaft 4. The rotor 5*c* is mounted on the rotary shaft 4 via the shaft securing body 5*e* and rotates together with the rotary shaft 4 as a single unit.

By contrast, the electromagnetic coil 5*d* is rotatably mounted on the shaft securing body 5*e*. Therefore, the electromagnetic coil 5*d* does not rotate even when the rotary shaft 4 rotates. Since the electric wire 5*h* that supplies electricity from the apparatus body of the image forming apparatus 100 is connected to the electromagnetic coil 5*d*, if the electromagnetic coil 5*d* rotates together with the rotary shaft 4, the electric wire 5*h* is cut off.

The drive connector 5*f* is rotatably mounted on the shaft securing body 5*e* and is movable in the axial direction of the rotary shaft 4.

The armature 5*b* is mounted on the drive connector 5*f*. While the electromagnetic coil 5*d* is being activated (when the electromagnetic clutch 5 is ON), the armature 5*b* is attracted and contacted to the rotor 5*c* due to a magnetic force. By contrast, while the electromagnetic coil 5*d* is not being activated (when the electromagnetic clutch 5 is OFF), the armature 5*b* is separated from the rotor 5*c*. That is, the drive connector 5*f* is movable in the axial direction of the rotary shaft 4 between the rotor 5*c* and the clearance retainer 5*g* that is fixed to the rotary shaft 4. Further, a clearance formed between the drive connector 5*f* and the shaft securing body 5*e* is greater than a clearance formed between the pulley 6 and the rotary shaft 4 so that the armature 5*b* slides toward the rotor 5*c* to contact the rotor 5*c* reliably when the electromagnetic clutch 5 is ON.

The drive connector 5*f* includes at least the pair of driving pawls 5*a* that extend toward the pulley 6. A leading end of one of the pair of driving pawls 5*a* is fitted to at least a corresponding one of a pair of drive coupling openings 6*a* of the pulley 6 by clearance fit. In other words, the driving pawl 5*a* is fitted to the drive coupling opening 6*a* with a certain clearance.

The pulley 6 is rotatably disposed with a minimum clearance for rotating about the rotary shaft 4. Simultaneously, an E ring 4*e* restrains movement of the pulley 6 in the axial direction of the rotary shaft 4.

Further, as illustrated in FIG. 3, an insertion amount W1 of each of the pair of driving pawls 5*a* to the corresponding one of the pair of drive coupling openings 6*a* is greater than a slide amount W2 of the drive connector 5*f* due to the attraction of the armature 5*b* to the rotor 5*c* when the electromagnetic clutch 5 is ON.

Accordingly, irrespective of the sliding of the drive connector 5*f*, the drive connector 5*f* and the pulley 6 can rotate about the rotary shaft 4 as a single unit with the rotary shaft 4 under a condition in which one of the pair of driving pawls 5*a* remains fitted to the corresponding one of drive coupling openings 6*a* by clearance fit.

Figure 4:
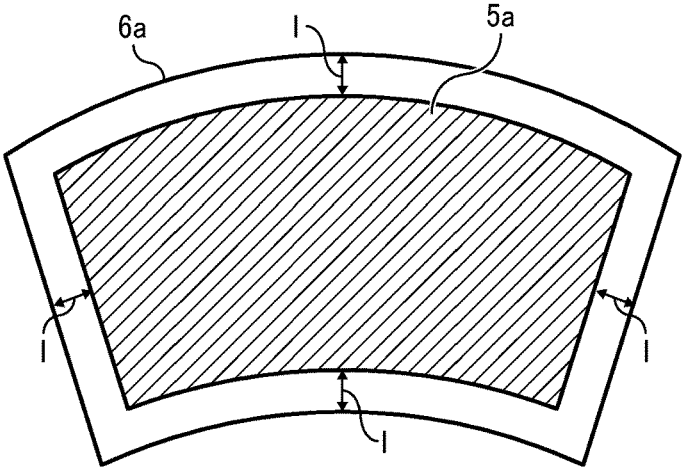
FIG. 4 is a schematic diagram illustrating a driving pawl and a drive coupling opening included in the electromagnetic clutch of FIG. 3.

FIG. 4 is a diagram illustrating an example of the shapes of the pair of driving pawls 5*a* and one of the pair of drive coupling openings 6*a*.

As illustrated in FIG. 4, the pair of driving pawls 5*a* is fitted to the pair of drive coupling openings 6*a* by clearance fit. The pair of drive coupling openings 6*a* has respective predetermined clearances 1 over the entire circumference.

It is to be noted that the driving pawl 5*a* and the drive coupling opening 6*a* have substantially similar shapes to each other in FIG. 4. However, the shapes are not limited thereto. Any shape can be applied as long as the driving pawl 5*a* and the drive coupling opening 6*a* absorb rattling of the drive connector 5*f* to the rotary shaft 4 and have a clearance that allows a drive transmission from the drive connector 5*f* to the pulley 6 to be performed normally.

Further, the configuration in FIG. 3 includes one pair of the pair of driving pawls 5*a* and one pair of the pair of drive coupling openings 6*a*. However, the configuration of the electromagnetic clutch 5 is not limited thereto. For example, this disclosure can be applied to a configuration in which three or more pairs of the pair of driving pawls 5*a* and three or more pairs of the pair of drive coupling openings 6*a* are provided. It is preferable that both the number of the pair of driving pawls 5*a* and the number of the pair of drive coupling openings 6*a* are multiples of 3.

Different from the electromagnetic clutch 5, a comparative electromagnetic clutch does not include a driving pawl such as the driving pawl 5*a* in FIG. 3 and a pulley such as the pulley 6 in FIG. 3. That is, in the comparative electromagnetic clutch, a drive connector such as the drive connector 5*f* acts as a drive transmission pulley and a drive transmission gear. Specifically, the comparative electromagnetic clutch includes the drive connector around which a timing belt such as the timing belt 10 is directly wound or with which a different drive transmission gear is meshed.

As described above, the drive connector is disposed with a predetermined clearance to a shaft securing body such that an armature attracts and connects a rotor reliably when the electromagnetic clutch is ON. Therefore, as the timing belt rotates when the electromagnetic clutch is OFF, the drive connector rotates to incline to the rotary shaft by the amount of the predetermined clearance between the drive connector and the shaft securing body. As a result, as the drive connector continues rotating, the timing belt comes off from the drive connector that functions as a drive transmission pulley, and therefore it is likely to cause a transmission failure, for example, the drive transmission is cut off.

Further, when the drive connector functions as a drive transmission gear, a meshing condition with another drive transmission gear becomes worse. Accordingly, it is likely to cause another transmission failure, for example, damage to teeth of the drive transmission gear and occurrence of noise or vibration due to inappropriate meshing of these transmission gears.

By contrast, the electromagnetic clutch 5 according to the present embodiment of this disclosure includes the drive connector 5*f* and the pulley 6 separately, as illustrated in FIG. 3. At the same time, the pair of driving pawls 5*a* are mounted on the drive connector 5*f*. In addition, each of the pair of driving pawls 5*a* is fitted to the corresponding one of the pair of drive coupling openings 6*a* of the pulley 6 by clearance fit, that is, with a predetermined clearance. Further, even when the drive connector 5*f* slides toward the rotary shaft 4 in the axial direction, the insertion state of the pair of driving pawls 5*a* fitted to the pair of drive coupling openings 6*a* by clearance fit is maintained.

Therefore, when the electromagnetic clutch 5 is OFF, the timing belt 10 can rotate the pulley 6 and the drive connector 5*f* rotates around the rotary shaft 4 due to the state of the pair of driving pawls 5*a* and the pair of drive coupling openings 6*a*. At that time, the drive connector 5*f* rotates while being inclined to the rotary shaft 4, as previously described. However, since the pulley 6 is rotatably disposed with the minimum clearance for rotating around the rotary shaft 4, the pulley 6 does not incline to the rotary shaft 4 while rotating around the rotary shaft 4.

As a result, the configuration of the electromagnetic clutch 5 according to the present embodiment of this disclosure can restrain or prevent occurrence of the drive transmission failures that are likely to be caused in the comparative electromagnetic clutch, for example, an unexpected cut off of a drive transmission due to a coming off of a timing belt, a damage to teeth of a drive transmission gear, and occurrence of noise and vibration of an inappropriate gear meshing.

In the drive device 30 illustrated in FIG. 2, when the sheet output roller 161*a* is rotated in a state in which the electromagnetic clutch 5 is turned off, the drive transmission from the motor 1 to the sheet output roller 161*a* is performed as follows.

The motor 1 drives the motor gear 1*a* to rotate an external gear 3 via the idler gear 2. The driving force of the external gear 3 is then transmitted to the external gear 7. Thereafter, the driving force passes the torque limiter 8 that is engaged with the external gear 7 via the coupling 8*a*, and is eventually transmitted to the rotary shaft 9. Since the electromagnetic clutch 5 remains turned off, even if the rotary shaft 4 rotates, the electromagnetic clutch 5 spins. According to this configuration, the driving force of the rotary shaft 4 is not transmitted to the pulley 6, and therefore the driving force of the rotary shaft 4 is not transmitted to the rotary shaft 9 via the drive transmission route including the pulley 6 and the timing belt 10 (i.e., the second drive transmission route R2). Accordingly, the sheet output roller 161*a* mounted on the rotary shaft 4 is rotated in the reverse direction that is an opposite direction to the rotation of the rotary shaft 4 by the driving force transmitted from the first drive transmission route R1 including the external gear 3, the external gear 7, and the torque limiter 8.

By contrast, in the drive device 30 illustrated in FIG. 2, when the sheet output roller 161*a* is rotated in the state in which the electromagnetic clutch 5 is turned on, the drive transmission from the motor 1 to the sheet output roller 161*a* is performed as follows.

The motor 1 drives the motor gear 1*a* to rotate the external gear 3 via the idler gear 2. The driving force of the external gear 3 is then transmitted to the external gear 7. Thereafter, the driving force passes the torque limiter 8 that is engaged with the external gear 7 via the coupling 8*a*, and is eventually transmitted to the rotary shaft 9. Accordingly, the driving force inputted to the rotary shaft 9 is to rotate the rotary shaft 9 in the opposite direction to the rotation of the rotary shaft 4. Since the electromagnetic clutch 5 is turned on, the electromagnetic clutch 5 is attached to the rotary shaft 4 and rotates together with the rotary shaft 4. Therefore, the driving force of the rotary shaft 4 is transmitted to the pulley 6 via the electromagnetic clutch 5, so that the driving force is then transmitted from the pulley 6 to the pulley 11 via the timing belt 10. Accordingly, the driving force inputted to the rotary shaft 9 having the pulley 11 thereon is to rotate the rotary shaft 9 in the same direction as the rotation of the rotary shaft 4.

Here, two driving forces to rotate the rotary shaft 9 in two different directions are inputted to the rotary shaft 9. The torque limiter 8 sets a drag torque as the predetermined set torque value to be greater than a drive torque of the rotary shaft 9 to the sheet output roller 161*a* and smaller than a transmission torque of the electromagnetic clutch 5. Therefore, when the torque limiter 8 receives the transmission torque of the electromagnetic clutch 5, the torque limiter 8 spins. Therefore, the drive transmission from the first drive transmission route R1 to the rotary shaft 9 is cut off. Due to the drive transmission from the second drive transmission route R2, the rotary shaft 9 is rotated in the same direction as the rotation of the rotary shaft 4. Accordingly, the sheet output roller 161*a* mounted on the rotary shaft 9 is rotated in the same direction as the rotation of the rotary shaft 4 by the driving force transmitted from the second drive transmission route R2 including the electromagnetic clutch 5, the pulley 6, the timing belt 10, and the pulley 11.

When compared with a drive transmission route including the external gears 3 and 7 (e.g., the first drive transmission route R1), a drive transmission route including the timing belt 10 (e.g., the second drive transmission route R2) can be expected to achieve quietness of an area where a roller or a shaft performs high speed rotation. Therefore, between the rotation of the sheet output roller 161*a* in the forward direction and the rotation of the sheet output roller 161*a* in the reverse direction, the drive transmission route including the timing belt 10 is preferably used to transmit the driving force at a higher rotation speed.

Further, the electromagnetic clutch 5 attracts and contacts the rotor 5*c* and the armature 5*b*, both are made of metal. The rotor 5*c* and the armature 5*b* transmit the driving force by driving in a single unit. However, the rotor 5*c* and the armature 5*b* are repeatedly attached to and detached from each other while the rotary shaft 4 is rotating. Therefore, coating on the surface of the rotor 5*c* and the armature 5*b* are peeled and the bare metal shows. Accordingly, rust occurs. Further, when the electromagnetic clutch 5 is turned on, energy is consumed. In order to reduce the consumption of energy to the minimum, if the electromagnetic clutch 5 is repeatedly turned on and off, rust occurs easily, and therefore it is difficult to make the durability compatible with energy saving.

Accordingly, of the two drive transmission routes, the drive transmission route to rotate the sheet output roller 161*a* in the reverse direction is employed to transmit the driving force via the electromagnetic clutch 5. This drive transmission route is used for the drive transmission for a shorter time or the drive transmission performed less frequently.

By contrast, the drive transmission route to rotate the sheet output roller 161*a* in the forward direction is employed to transmit the driving force via the torque limiter 8. This drive transmission route is used for the drive transmission for a longer time or the drive transmission performed more frequently. Due to this configuration, since the drive transmission route to rotate the sheet output roller 161*a* in the forward direction is used for the drive transmission for a longer time or the drive transmission performed more frequently, the electromagnetic clutch 5 is not employed. Therefore, the electromagnetic clutch 5 does not repeat the turning on and off frequently. Accordingly, the above-described inconvenience such as occurrence of rust and energy saving can be restrained. As a result, the drive device 30 and the image forming apparatus 100 can achieve good reliability and energy saving.

Accordingly, the configuration of the drive device 30 according to Configuration Example 1 of this disclosure can enhance a reduction in time of switching operations of rotations of the sheet output roller 161*a*.

CONFIGURATION EXAMPLE 2

Figure 5:
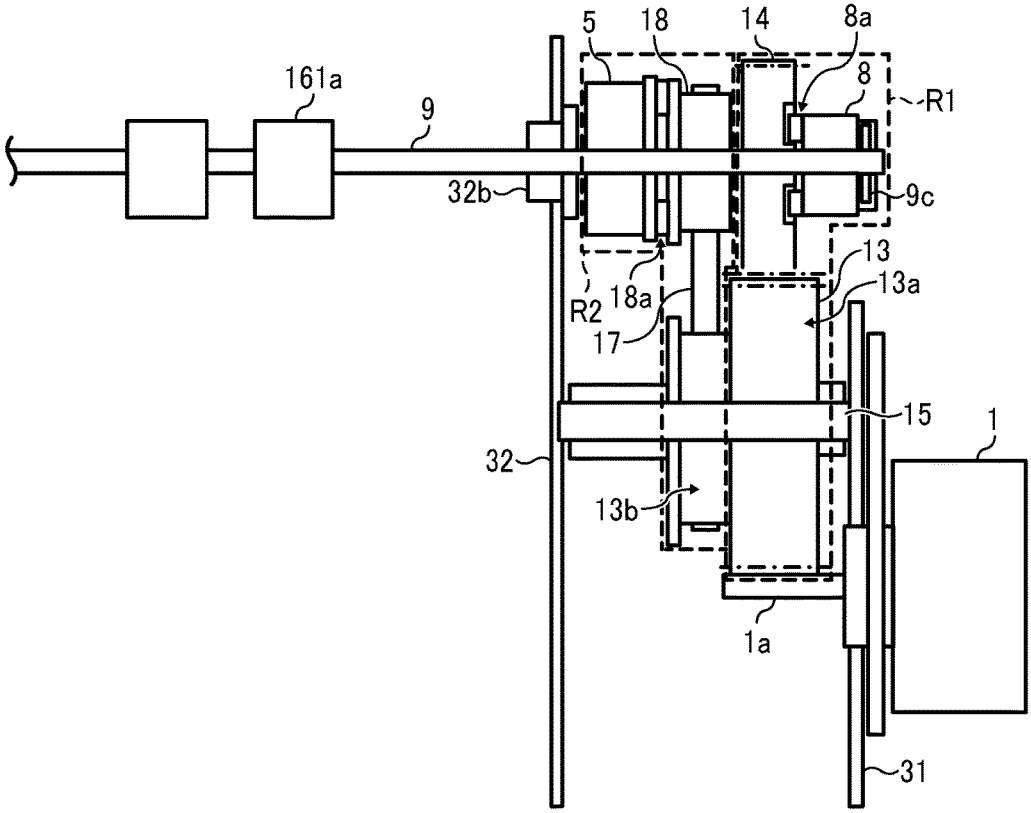
FIG. 5 is a schematic cross sectional view illustrating a drive device of Configuration Example 2.

FIG. 5 is a schematic cross sectional view illustrating the drive device 30 of Configuration Example 2.

As illustrated in FIG. 5, the drive device 30 of Configuration Example 2 includes the motor 1 that functions as a drive source that can rotate in both forward and reverse directions. The motor 1 is attached to the side panel 31. The side panel 31 is disposed facing the side panel 32. The drive device 30 further includes a fixed shaft 15 and an idler gear pulley 13. The fixed shaft 15 is fixed to the side panel 31 and the side panel 32. The idler gear pulley 13 is rotatably supported by the fixed shaft 15 and includes an external gear part 13*a*. The motor gear 1*a* of the motor 1 is meshed with the external gear part 13*a* of the idler gear pulley 13. The rotary shaft 9 of the sheet output roller 161*a* is disposed shifted from a fixed shaft 15 in a radial direction of the sheet output roller 161*a*. The rotary shaft 9 is rotatably supported by the bearing 32*b* that is mounted on the side panel 32.

An external gear 14 is meshed with the external gear part 13*a* and is rotatably supported by the rotary shaft 9. The torque limiter 8 is secured by a parallel pin 9*c* to an axial end of the rotary shaft 9. The external gear 14 and the torque limiter 8 are engaged via the coupling 8*a*.

Further, a pulley 18 and the electromagnetic clutch 5 are coaxially mounted on the rotary shaft 9. The pulley 18 and the electromagnetic clutch 5 are disposed closer to the sheet output roller 161*a* than the external gear 14 in the axial direction of the rotary shaft 9. The pulley 18 is rotatably supported by the rotary shaft 9. The electromagnetic clutch 5 is supported by the rotary shaft 9 to be fastened to or released from the rotary shaft 9.

Consequently, the electromagnetic clutch 5 and the pulley 18 are engaged with each other via a coupling 18*a*, and therefore can rotate as a single unit. A pulley body 13*b* of the idler gear pulley 13 is mounted on the fixed shaft 15. A timing belt 17 is wound around the pulley body 13*b* and the pulley 18 supported by the rotary shaft 9.

In the drive device 30 illustrated in FIG. 5, the first drive transmission route R1, which is one of the two drive transmission routes that transmit the driving force exerted by the motor 1 to the sheet output roller 161*a*, is defined by the external gear part 13*a*, the external gear 14, and the torque limiter 8. Further, the second drive transmission route R2 is the other of the two drive transmission routes and is defined by the pulley body 13*b*, the timing belt 17, the pulley 18, and the electromagnetic clutch 5. In drive transmission via the first drive transmission route R1 and the second drive transmission route R2, the sheet output roller 161*a* rotates in opposite directions in the first drive transmission route R1 and the second drive transmission route R2. That is, the direction of rotation of the sheet output roller 161*a* in the first drive transmission route R1 is opposite to the direction of rotation of the sheet output roller 161*a* in the second drive transmission route R2.

In the drive device 30 illustrated in FIG. 5, when the sheet output roller 161*a* is rotated in the state in which the electromagnetic clutch 5 is turned off, the drive transmission from the motor 1 to the sheet output roller 161*a* is performed as follows.

The motor 1 drives the motor gear 1*a* to rotate the external gear 14 via the external gear part 13*a* of the idler gear pulley 13. The driving force of the external gear part 13*a* is then transmitted to the external gear 14. Thereafter, the driving force passes the torque limiter 8 that is engaged with the external gear 14 via the coupling 8*a*, and is eventually transmitted to the rotary shaft 9. Since the electromagnetic clutch 5 remains turned off, the electromagnetic clutch 5 that is attached to the rotary shaft 9 spins. Therefore, the driving force that is transmitted from the pulley body 13*b* of the idler gear pulley 13 to the pulley 18 via the timing belt 17 is not transmitted to the rotary shaft 9 via the electromagnetic clutch 5. According to this configuration, the driving force of the idler gear pulley 13 is not transmitted to the rotary shaft 9 via the second drive transmission route R2 including the pulley body 13*b*, the timing belt 17, the pulley 18, and the electromagnetic clutch 5. Accordingly, the sheet output roller 161*a* mounted on the rotary shaft 9 is rotated in the reverse direction that is an opposite direction to the rotation of the idler gear pulley 13 by the driving force transmitted from the first drive transmission route R1 including the external gear part 13*a*, the external gear 14, and the torque limiter 8.

By contrast, in the drive device 30 illustrated in FIG. 5, when the sheet output roller 161*a* is rotated in the state in which the electromagnetic clutch 5 is turned on, the drive transmission from the motor 1 to the sheet output roller 161*a* is performed as follows.

The motor 1 drives the motor gear 1*a* to rotate the external gear 14 via the external gear part 13*a* of the idler gear pulley 13. The driving force of the external gear part 13*a* is then transmitted to the external gear 14. Thereafter, the driving force passes the torque limiter 8 that is engaged with the external gear 14 via the coupling 8*a*, and is eventually transmitted to the rotary shaft 9. Accordingly, the driving force inputted to the rotary shaft 9 is to rotate the rotary shaft 9 in the reverse direction that is an opposite direction to the rotation of the idler gear pulley 13. Since the electromagnetic clutch 5 remains turned on, the electromagnetic clutch 5 attached to the rotary shaft 9 rotates together with the rotary shaft 9. According to this configuration, the driving force of the pulley body 13*b* of the idler gear pulley 13 is transmitted to the pulley 18 via the timing belt 17, and then to the rotary shaft 9 via the electromagnetic clutch 5. Accordingly, the rotary shaft 9 is to receive the driving force to rotate the rotary shaft 9 in the same direction as the direction to the rotation of the idler gear pulley 13.

Here, two driving forces to rotate the rotary shaft 9 in two different directions are inputted to the rotary shaft 9. The torque limiter 8 sets a drag torque as the predetermined set torque value to be greater than a drive torque of the rotary shaft 9 to the sheet output roller 161*a* and smaller than a transmission torque of the electromagnetic clutch 5. According to this setting, on receipt of the transmission torque of the electromagnetic clutch 5, the torque limiter 8 spins to cut off the drive transmission to the rotary shaft 9 via the first drive transmission route R1. Therefore, the drive transmission via the second drive transmission route R2 rotates the rotary shaft 9 in the same direction as the rotation of the idler gear pulley 13. Accordingly, the sheet output roller 161*a* mounted on the rotary shaft 9 is rotated in the same direction as the rotation of the idler gear pulley 13 by the driving force transmitted via the second drive transmission route R2 including the pulley body 13*b*, the timing belt 17, the pulley 18, and the electromagnetic clutch 5.

Further, the drive device 30 of Configuration Example 2 can include the fixed shaft 15 illustrated in FIG. 5 instead of the rotary shaft 4 included in the drive device 30 of Configuration Example 1 illustrated in FIG. 1. Therefore, the bearings 31*a* and 32*a* supporting the rotary shaft 4 are not employed in the drive device 30 of Configuration Example 2. Accordingly, a reduction in cost can be achieved. In addition, the drive device 30 of Configuration Example 2 includes the torque limiter 8 and the electromagnetic clutch 5 both mounted on the rotary shaft 9 of the sheet output roller 161*a*. Therefore, when compared with the drive device 30 of Configuration Example 1, the operability of replacement of the electromagnetic clutch 5 can be enhanced. It is to be noted that the rotary shaft 4 illustrated in FIG. 1 is removed when replacing the electromagnetic clutch 5 in the drive device 30 of Configuration Example 1. This operation can make replacement of the electromagnetic clutch 5 complicated. Accordingly, the configuration of the drive device 30 according to Configuration Example 2 of this disclosure can enhance a reduction in time of switching operations of rotations of the sheet output roller 161*a*.

CONFIGURATION EXAMPLE 3

Figure 6:
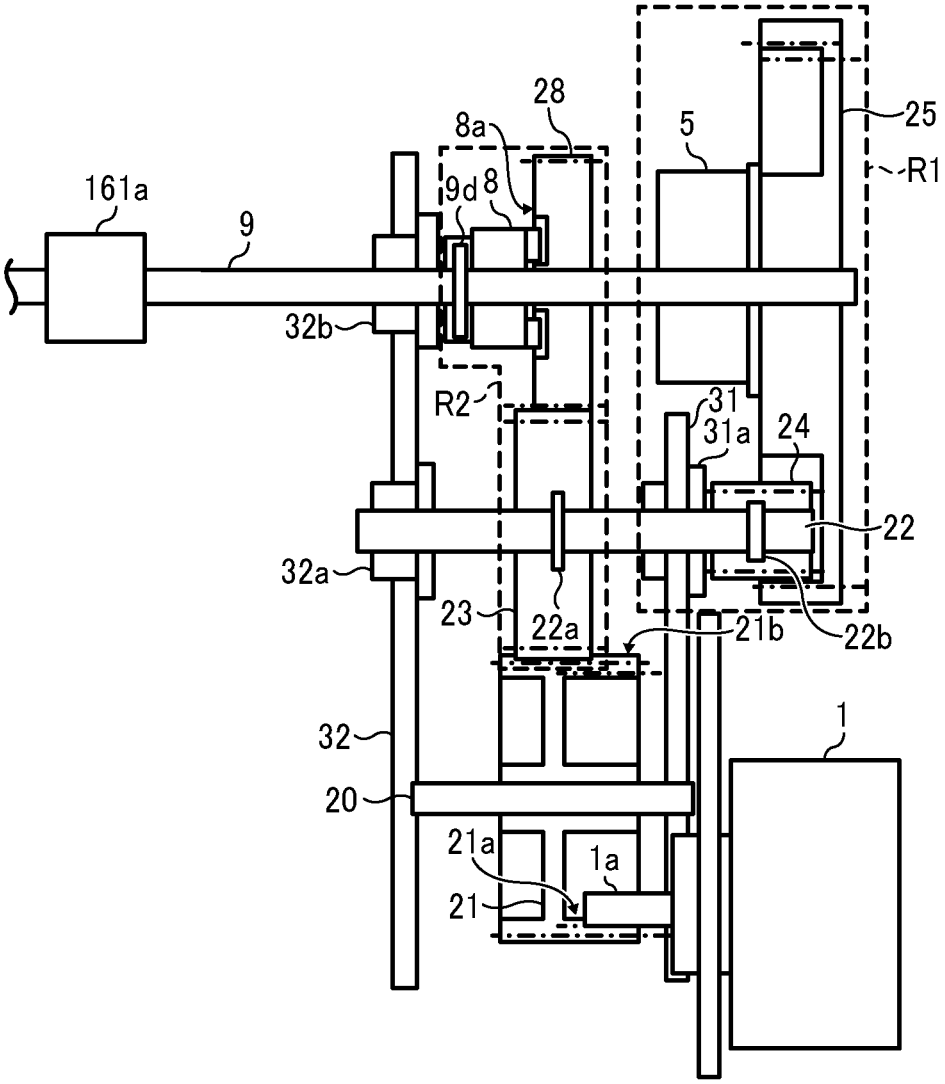
FIG. 6 is a schematic cross sectional view illustrating a drive device of Configuration Example 3.

FIG. 6 is a schematic cross sectional view illustrating the drive device 30 of Configuration Example 3.

As illustrated in FIG. 6, the drive device 30 of Configuration Example 3 includes the motor 1 that functions as a drive source that can rotate in both forward and reverse directions. The motor 1 is attached to the side panel 31. The side panel 31 is disposed facing the side panel 32. The drive device 30 further includes a fixed shaft 20 and an idler gear 21. The fixed shaft 20 is fixed to the side panel 31 and the side panel 32. The idler gear 21 is rotatably supported by the fixed shaft 20 and includes an internal gear part 21*a*. The motor gear 1*a* is mounted on the fixed shaft 20 and is meshed with the internal gear part 21*a* of the idler gear 21. The idler gear 21 further includes an external gear part 21*b* concentrically. The external gear part 21*b* is meshed with an external gear 23 that is secured by a parallel pin 22*a* to a rotary shaft 22. The bearing 31*a* is mounted on the side panel 31 and the bearing 32*a* is mounted on the side panel 32. By so doing, the rotary shaft 22 is rotatably supported by the bearing 31*a* and the bearing 32*a*.

An external gear 24 is coaxially secured by a parallel pin 22*b* to an axial end of the rotary shaft 22, which is an opposite side to the sheet output roller 161*a*. The external gear 24 is meshed with an internal gear 25 that is rotatably supported by the rotary shaft 9 of the sheet output roller 161*a*. The rotary shaft 9 is rotatably supported by the bearing 32*b* mounted on the side panel 32. The electromagnetic clutch 5 that can rotate with the internal gear 25 as a single unit is located near or substantially adjacent to the internal gear 25 in the axial direction of the rotary shaft 9. The electromagnetic clutch 5 is supported by the rotary shaft 9 to be fastened to or released from the rotary shaft 9.

An external gear 28 that is meshed with the external gear 23 is rotatably supported by the rotary shaft 9 is disposed closer to the sheet output roller 161*a* than the electromagnetic clutch 5 in the axial direction of the rotary shaft 9. The external gear 28 is engaged with the torque limiter 8 via the coupling 8*a*. The torque limiter 8 in FIG. 6 is fixed to the rotary shaft 9 by a parallel pin 9*d*.

In the drive device 30 illustrated in FIG. 6, the first drive transmission route R1, which is one of the two drive transmission routes that transmit the driving force exerted by the motor 1 to the sheet output roller 161*a*, is defined by the external gear 24, the internal gear 25, and the electromagnetic clutch 5. Further, the second drive transmission route R2 is the other of the two drive transmission routes and is defined by the external gear 23, the external gear 28, and the torque limiter 8. In drive transmission via the first drive transmission route R1 and the second drive transmission route R2, the sheet output roller 161*a* rotates in opposite directions in the first drive transmission route R1 and the second drive transmission route R2. That is, the direction of rotation of the sheet output roller 161*a* in the first drive transmission route R1 is opposite to the direction of rotation of the sheet output roller 161*a* in the second drive transmission route R2.

In the drive device 30 illustrated in FIG. 6, when the sheet output roller 161*a* is rotated in the state in which the electromagnetic clutch 5 is turned off, the drive transmission from the motor 1 to the sheet output roller 161*a* is performed as follows.

The motor 1 drives the motor gear 1*a* to rotate the external gear 23 via the internal gear part 21*a* and the external gear part 21*b* of the idler gear 21. By so doing, the external gear 28 that is meshed with the external gear 23 is rotated to input a driving force to the rotary shaft 9 via the torque limiter 8 that is engaged with the external gear 28 via the coupling 8*a*. The driving force inputted to the rotary shaft 9 rotates the rotary shaft 9 in the reverse direction that is an opposite direction to the rotation of the rotary shaft 22. Since the electromagnetic clutch 5 remains turned off, the electromagnetic clutch 5 spins. Therefore, the driving force that is transmitted from the external gear 24 mounted on the rotary shaft 22 together with the external gear 23 to the internal gear 25 is not transmitted to the rotary shaft 9 vial the electromagnetic clutch 5. According to this configuration, the driving force of the motor 1 is not transmitted to the rotary shaft 9 via the first drive transmission route R1 that includes the external gear 24, the internal gear 25, and the electromagnetic clutch 5. Accordingly, the sheet output roller 161*a* mounted on the rotary shaft 9 is rotated in the reverse direction that is an opposite direction to the rotation of the rotary shaft 22 on which the external gear 23 is mounted, by the driving force transmitted via the second drive transmission route R2 including the external gear 23, the external gear 28, and the torque limiter 8.

By contrast, in the drive device 30 illustrated in FIG. 6, when the sheet output roller 161*a* is rotated in the state in which the electromagnetic clutch 5 is turned on, the drive transmission from the motor 1 to the sheet output roller 161*a* is performed as follows.

The motor 1 drives the motor gear 1*a* to rotate the external gear 23 via the internal gear part 21*a* and the external gear part 21*b* of the idler gear 21. By so doing, the external gear 28 that is meshed with the external gear 23 is rotated to input a driving force to the rotary shaft 9 via the torque limiter 8 that is engaged with the external gear 28 via the coupling 8*a*. The driving force inputted to the rotary shaft 9 rotates the rotary shaft 9 in the reverse direction that is an opposite direction to the rotation of the rotary shaft 22. Since the electromagnetic clutch 5 remains turned on, the electromagnetic clutch 5 attached to the rotary shaft 9 rotates together with the rotary shaft 9 as a single unit. According to this configuration, the driving force of the external gear 23 is transmitted to the external gear 24 that is mounted on the rotary shaft 22 together with the external gear 23, and is then transmitted to the internal gear 25. Thereafter, the driving force is eventually transmitted to the rotary shaft 9 via the electromagnetic clutch 5. Accordingly, the rotary shaft 9 is to receive the driving force to rotate the rotary shaft 9 in the same direction as the direction to the rotation of the rotary shaft 22.

Here, two driving forces to rotate the rotary shaft 9 in two different directions are inputted to the rotary shaft 9. The torque limiter 8 sets a drag torque as the predetermined set torque value to be greater than the drive torque of the rotary shaft 9 to the sheet output roller 161*a* and smaller than the transmission torque of the electromagnetic clutch 5. Therefore, when the torque limiter 8 receives the transmission torque of the electromagnetic clutch 5, the torque limiter 8 spins. Therefore, the drive transmission from the second drive transmission route R2 to the rotary shaft 9 is cut off. Due to the drive transmission from the first drive transmission route R1, the rotary shaft 9 is rotated in the same direction as the rotation of the rotary shaft 22. Accordingly, the sheet output roller 161*a* mounted on the rotary shaft 9 is rotated in the same direction as the rotation of the rotary shaft 22 by the driving force transmitted via the first drive transmission route R1 including the external gear 24, the internal gear 25, and the electromagnetic clutch 5.

In addition, by including a drive transmission route with an internal gear (i.e., the internal gear 25) therein as the drive device 30 of Configuration Example 3, a meshing portion meshed with an external gear (i.e., the external gear 24) to which a driving force is inputted can be covered by the internal gear. Therefore, the configuration can prevent noise generated in the meshing portion from leaking to the outside of the drive device 30 or the image forming apparatus 100 by the internal gear. Further, when compared with a meshing with two external gears, a meshing with an internal gear and an external gear can increase a contact ratio with each other. Therefore, this configuration can prevent occurrence of noise and vibration in the drive device 30 or the image forming apparatus 100. Consequently, the quietness of the drive device 30 can increase. Therefore, it is preferable that a drive transmission route in which an internal gear is provided is used for the drive transmission for a longer time or the drive transmission performed more frequently. Specifically, the sheet output roller 161*a* takes longer time and performs frequently to rotate in the forward direction to eject the recording medium P to the sheet stacking portion 56 than in the reverse direction to switchback the recording medium P. Accordingly, when the drive transmission is performed via the first drive transmission route R1, the sheet output roller 161*a* is rotated in the forward direction to enhance the quietness of the drive device 30 effectively.

Accordingly, the configuration of the drive device 30 according to Configuration Example 1 of this disclosure can enhance a reduction in time of switching operations of rotations of the sheet output roller 161*a*.

It is to be noted that, in the drive device 30 according to any one of Configuration Examples 1, 2, and 3, the torque limiter 8 is employed to cut off the drive transmission when a torque equal to or greater than the predetermined set torque value is received in the drive device 30. However, the configuration is not limited thereto. For example, a bidirectional clutch in which a torque (a rotational driving force) from an input shaft is transmitted to an output shaft but not from the output shaft to the input shaft can be used as a torque limiter.

Further, in the drive device 30 according to the present embodiment of this disclosure, respective drive transmissions via the first drive transmission route R1 and the second drive transmission route R2 have different rotation direction of the sheet output roller 161*a*. However, this configuration is not limited, either. That is, this disclosure can adjust the number and diameters of external gears and the number of teeth of the external gears, so as to have the same direction of rotation of the sheet output roller 161*a* and the different speeds of rotations between a drive transmission route provided with a timing belt and a drive transmission route provided with an external gear.

Further, this disclosure can also adjust the number and diameters of external gears and the number of teeth of the external gears, so as to have the same direction of rotation of the sheet output roller 161*a* and the different speeds of rotations between a drive transmission route provided with an internal gear and a drive transmission route provided with an external gear. Further, both the first drive transmission route R1 and the second drive transmission route R2 may include respective timing belts. Accordingly, when compared with a configuration including gears, either one of the first drive transmission route R1 and the second drive transmission route R2 can enhance quietness of the image forming apparatus 100.

The configurations according to the above-descried embodiments are examples and not limited thereto. This disclosure can achieve the following aspects effectively.

Aspect A.

In Aspect A, a drive device such as the drive device 30 includes a drive source such as the motor 1, an input side rotary body such as the rotary shaft 4, an output side rotary body such as the rotary shaft 9, two drive transmission routes such as the first drive transmission route R1 and the second drive transmission route R2, a drive transmission state switcher such as the electromagnetic clutch 5, and a drive transmission changer such as the torque limiter 8. The drive source exerts a driving force. The input side rotary body is rotatably disposed to receive the driving force from the drive source. The output side rotary body is rotatably disposed to output the driving force to a driving target body such as the sheet output roller 161*a*. The two drive transmission routes transmit the driving force from the input side rotary body to the output side rotary body. The two drive transmission routes include the first drive transmission route R1 and the second drive transmission route R2. The drive transmission state switcher is configured to switch the first drive transmission route between a transmission state in which the driving force is transmitted and a non transmission state in which transmission of the driving force is cut off. The drive transmission changer is configured to transmit the driving force via the second drive transmission route to the output side rotary body when the first drive transmission route is in the non transmission state and configured to restrict the driving force from transmitting the driving force via the second drive transmission route when the first drive transmission route to the output side rotary body is in the transmission state.

In Aspect A, the drive transmission changer changes whether to allow or prohibit drive transmission of the driving force to the output side rotary shaft via the second drive transmission route according to the switching between the transmission state and the non transmission state of the first drive transmission route by the drive transmission state switcher.

According to this configuration, the first drive transmission route and the second drive transmission route can be switched. Therefore, a drive transmission route from the input side rotary body to the output side rotary body can be changed between the first drive transmission route and the second drive transmission route and the state of the drive transmission to the driving target body in a period of time for switching one drive transmission state switcher. Accordingly, when compared with the configuration in which two different drive transmission state switchers according to both of the two drive transmission routes, the period of time for switching the drive transmission of the driving target body can be reduced.

Aspect B.

In Aspect A, the input side rotary body includes an input side rotary shaft and the drive transmission state switcher is mounted on the input side rotary shaft.

According to this configuration, as descried in the above-described embodiment, the input side rotary shaft can be used for another driving force.

Aspect C.

In Aspect A, the output side rotary body includes an output side rotary shaft and the drive transmission state switcher and the drive transmission changer are mounted on the output side rotary shaft.

According to this configuration, as descried in the above-described embodiment, the drive transmission state switcher and the drive transmission changer can be mounted on the same rotary shaft. Accordingly, the good replaceability of the drive transmission state switcher can be obtained.

Aspect D.

In any one of Aspect A through Aspect C, one of the two drive transmission routes transmits the driving force by a belt such as the timing belt 10 and the other of the two drive transmission routes transmits the driving force by an external gear such as the external gear 3 and the external gear 7.

According to this configuration, as descried in the above-described embodiment, when compared to a drive transmission route transmitting a driving force by a gear, the drive transmission route transmitting the driving force by the belt has good quietness in a high-speed area. Accordingly, by providing the configuration in which the one of the multiple drive transmission routes includes the belt, when compared to the configuration using the gear, the quietness can be enhanced.

Further, the external gear has a higher durability compared to the belt. Accordingly, by performing the drive transmission via the other of the multiple drive transmission routes by the external gear, the durability of the drive transmission route can be enhanced.

Aspect E.

In any one of Aspect A through Aspect C, one of the two drive transmission routes transmits the driving force by an internal gear such as the internal gear 25 and the other of the two drive transmission routes transmits the driving force by an external gear such as the external gear 23 and the external gear 28.

According to this configuration, as descried in the above-described embodiment, when compared to a drive transmission route transmitting a driving force by an external gear, the drive transmission route transmitting the driving force by the internal gear can enhance the contact ratio. Accordingly, by providing the configuration in which the one of the multiple drive transmission routes includes the internal gear, occurrences of non-uniformity in rotation, noise, and vibration can be restrained.

Further, the external gear has a higher durability compared to the belt. Accordingly, by performing the drive transmission via the other of the multiple drive transmission routes by the external gear, the durability of the drive transmission route can be enhanced.

Aspect F.

In any one of Aspect A through Aspect E, the drive transmission changer includes a torque limiting device to cut off the drive transmission on receipt of a torque equal to or greater than a predetermined set torque value. The predetermined set torque value is greater than a drive torque of the output side rotary body to the driving target body and smaller than a transmission torque of the drive transmission state switcher.

According to this configuration, as descried in the above-described embodiment, the driving target body can be drive by the driving force exerted by the drive transmission state switcher.

Aspect G.

In Aspect F, the torque limiter includes a torque limiter to idle on receipt of the torque greater than the predetermined set torque value.

According to this configuration, the transmission of the driving force and the cutting off of transmission of the driving force can be changed by a simple configuration.

Aspect H.

In any one of Aspect A through Aspect G, the drive transmission state switcher is provided to one of the two drive transmission routes. The one of the two drive transmission routes is used for either one of a drive transmission taking a shorter time and a drive transmission being performed less frequently than the other of the two drive transmission routes.

According to this configuration, as descried in the above-described embodiment, a reduction in power consumption and a high durability can be enhanced.

Aspect I.

In any one of Aspect A through Aspect H, the drive transmission state switcher includes an electromagnetic clutch such as the electromagnetic clutch 5.

Aspect J.

In Aspect I, the drive device such as the drive device 30 further includes a pulley such as the pulley 6 wound around the input side rotary body. The electromagnetic clutch and the pulley are coaxially mounted as separate units.

According to this configuration, as descried in the above-described embodiment, the accuracy of attachment of the pulley can be enhanced, and therefore the rotation accuracy of the driving target body can be enhanced. Further, the durability of the electromagnetic clutch can also be enhanced.

Aspect K.

In any one of Aspect A through Aspect J, the two drive transmission routes includes a route in which the input side rotary body and the output side rotary body rotate in a same direction as each other and a route in which the input side rotary body and the output side rotary body rotate in opposite directions to each other.

According to this configuration, as descried in the above-described embodiment, the time for switching the direction of rotation of the driving target body can be reduced.

Aspect L.

In Aspect L, an image forming apparatus such as the image forming apparatus 100 includes the dive device, such as the drive device 30, according to any one of Aspect A through Aspect K to transmit a driving force to drive the driving target body.

According to this configuration, as descried in the above-described embodiment, the time for switching the direction of rotation of the driving target body can be reduced.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive device comprising:

a drive source configured to exert a driving force;

an input side rotary shaft rotatably disposed and configured to receive the driving force from the drive source;

an output side rotary shaft rotatably disposed and configured to transmit the driving force to a driving target body configured to rotate in a forward direction or a reverse direction opposite to the forward direction;

a first drive transmission route configured to transmit the driving force from the input side rotary shaft to the output side rotary shaft if the driving target body is rotated in the forward direction; and a second drive transmission route configured to transmit the driving force from the input side rotary shaft to the output side rotary shaft if the driving target body is rotated in the reverse direction, the second drive transmission route including an electromagnetic clutch configured to switch the second drive transmission route between a transmission state in which the driving force is transmitted and a non-transmission state in which transmission of the driving force is cut off, wherein the first drive transmission route includes a torque limiter configured to, transmit the driving force via the first drive transmission route to the output side rotary shaft if the second drive transmission route is in the non-transmission state, and restrict the transmission of the driving force from the first drive transmission route to the output side rotary shaft if the second drive transmission route is in the transmission state, and the first drive transmission route does not include a clutch.

2. The drive device according to claim 1, wherein the electromagnetic clutch is mounted on the input side rotary shaft, and the torque limiter is attached onto the output side rotary shaft.

3. The drive device according to claim 2, wherein the second drive transmission route transmits the drive force with a belt, and the first drive transmission route transmits the drive force with an externally toothed gear.

4. The drive device according to claim 3, wherein the belt is wound around an input side pulley rotatably mounted on the input side rotary shaft and an output side pulley fixedly mounted on the output side rotary shaft.

5. The drive device according to claim 1, wherein the driving target body rotates in the forward direction in the first drive transmission route and rotates in the reverse direction in the second drive transmission route.

6. The drive device according to claim 5, wherein the electromagnetic clutch is configured to, operate in the non-transmission state to not transmit the transmission force, if the driving target body rotates in the forward direction, and operate in the transmission state to transmit the transmission force, if the driving target body rotates in the reverse direction.

7. The drive device according to claim 1, wherein the electromagnetic clutch includes:

an electromagnetic coil rotatably mounted on the input side rotary shaft;

a rotor fixedly mounted on the input side rotary shaft; and a drive connector rotatably mounted on the input side rotary shaft and movable in an axial direction between the rotor and an input side pulley mounted over the input side rotary shaft, the drive connector including at least one fitting insertion body configured to fit to be inserted into the input side pulley.

8. The drive device according to claim 7, wherein each of the at least one insertion body has one end in the axial direction to be fixed to the drive connector and an opposed end that is opposite to the one end and is inserted into a recess among at least one recess in the input side pulley.

9. The drive device according to claim 8, wherein an insertion amount in the axial direction between the at least one insertion body and the recess is greater than a moving amount of the drive connector in the axial direction.

10. The drive device according to claim 8, wherein a set clearance is formed between the insertion body and the recess.

11. The drive device according to claim 10, wherein the set clearance includes multiple set clearances uniformly provided on an outer circumference of the insertion body.

12. The drive device according to claim 8, wherein the insertion body and the recess have substantially similar shapes to each other.

13. The drive device according to claim 8, wherein a number of the at least one insertion body is identical to a number of the at least one recess.

14. The drive device according to claim 8, wherein a number of the at least one insertion body and a number of the at least one recess are multiples of 3.

15. An image forming apparatus comprising:

an image forming device to form an image; and the drive device according to claim 1, the drive device configured to drive the driving target body.

16. The image forming apparatus according to claim 15, wherein the driving target body is a sheet output roller.

17. A drive device comprising:

a drive source configured to exert a driving force;

an input side rotary shaft rotatably disposed and configured to receive the driving force from the drive source;

an output side rotary shaft rotatably disposed and configured to transmit the driving force to a driving target body configured to rotate in a forward direction or a reverse direction opposite to the forward direction;

a first drive transmission route configured to transmit the driving force from the input side rotary shaft to the output side rotary shaft if the driving target body is rotated in the forward direction; and a second drive transmission route configured to transmit the driving force from the input side rotary shaft to the output side rotary shaft if the driving target body is rotated in the reverse direction, the second drive transmission route including an electromagnetic clutch configured to switch the second drive transmission route between a transmission state in which the driving force is transmitted and a non-transmission state in which transmission of the driving force is cut off, wherein the only clutch in the drive device is the electromagnetic clutch included in the second drive transmission route, and the first drive transmission route includes a torque limiter configured to, transmit the driving force via the first drive transmission route to the output side rotary shaft if the second drive transmission route is in the non-transmission state, and restrict the transmission of the driving force from the first drive transmission route to the output side rotary shaft if the second drive transmission route is in the transmission state.

18. A drive device comprising:

a drive source configured to exert a driving force;

an input side rotary shaft rotatably disposed and configured to receive the driving force from the drive source;

an output side rotary shaft rotatably disposed and configured to transmit the driving force to a driving target body configured to rotate in a forward direction or a reverse direction opposite to the forward direction;

a first drive transmission route configured to transmit the driving force from the input side rotary shaft to the output side rotary shaft if the driving target body is rotated in the forward direction; and a second drive transmission route configured to transmit the driving force from the input side rotary shaft to the output side rotary shaft if the driving target body is rotated in the reverse direction, the second drive transmission route including an electromagnetic clutch configured to switch the second drive transmission route between a transmission state in which the driving force is transmitted and a non-transmission state in which transmission of the driving force is cut off, wherein the first drive transmission route includes a torque limiter configured to, transmit the driving force via the first drive transmission route to the output side rotary shaft if the second drive transmission route is in the non-transmission state, and restrict the transmission of the driving force from the first drive transmission route to the output side rotary shaft if the second drive transmission route is in the transmission state, and wherein the torque limiter and the electromagnetic clutch work together to transmit the drive force to the output side rotary shaft through either the first transmission route or the second transmission route.

* * * * *